US006135129A

United States Patent [19]

Akazawa

[11] Patent Number: 6,135,129

[45] Date of Patent: Oct. 24, 2000

[54] AIR INTAKE PASSAGE CLEANING METHOD AND ITS APPARATUS

[76] Inventor: Yasumasa Akazawa, 2-8-14 Higashishinmachi, Matsubara, Osaka, Japan

[21] Appl. No.: 09/390,990

[22] Filed: Sep. 7, 1999

Related U.S. Application Data

[62] Division of application No. 09/008,407, Jan. 17, 1998, Pat. No. 6,047,714.

[51] Int. Cl.[7] ..... B08B 9/04

[52] U.S. Cl. ..... 134/8; 15/104.061; 15/104.93

[58] Field of Search ..... 15/104.061, 104.93; 134/8

[56] References Cited

U.S. PATENT DOCUMENTS

| | | | |
|---|---|---|---|
| 3,179,375 | 4/1965 | Hamrick | 15/104.061 X |
| 4,141,753 | 2/1979 | Creed | 15/104.061 X |
| 4,720,884 | 1/1988 | Ralls | 15/104.061 |
| 5,472,514 | 12/1995 | Grimsley | 134/8 |
| 5,625,917 | 5/1997 | Hawkins | 15/104.061 |
| 5,868,858 | 2/1999 | Creed | 134/8 |

*Primary Examiner*—Chris K. Moore
*Attorney, Agent, or Firm*—Moonray Kojima

[57] ABSTRACT

The present invention provides air intake passage cleaning method and its apparatus for cleaning the air intake passage of intake and exhaust apparatus for conditioning the air in building, ship, aircraft, automobile, train, or other room, to be used in an intake and exhaust apparatus comprising a fleat exchanger, and at least one blow-out port for blowing out air conditioning air exchanged in heat by the heat exchanger, comprising supplying means for supplying a cleaning solvent, together with compressed air, to the heal exchanger side from a specific blow-out port through an air intake passage, and moving means for moving cleaning and wiping elements loaded in the air intake passage toward a specific blow-out port side, and hence relates to air intake passage cleaning method and its apparatus capable of securely cleaning and removing dirt deposits in the air intake passage and heat exchanger, and obtaining sanitary environments.

6 Claims, 11 Drawing Sheets

AIR INTAKE PASSAGE CLEANING METHOD AND ITS APPARATUS

This is a division, of application Ser. No. 09/008,407, filed Jan. 17, 1998, now U.S. Pat. No. 6,047,714, issued Apr. 11, 2000.

BACKGROUND OF THE INVENTION

1. Field of the Invention

The present invention relates to air intake passage cleaning method and its apparatus for cleaning the air intake passage of intake and exhaust apparatus such as air conditioning passage of air conditioner for conditioning the air in, for example, building, ship, aircraft, automobile, train, or other room.

2. Description of the Prior Art

Hitherto, the air conditioner incorporates, in its housing, a heat exchanger which acts as an evaporator in cooling and a condenser in heating, and the heat exchanger and air intake passage are likely to be contaminated, and germs and molds are formed in the process of heat exchange of the indoor air containing dust, moisture, cigarette smoke or the like taken in from the air suction port provided in the housing.

When air conditioning is operated in such state, the sanitation in the room is spoiled, and the indoor environments deteriorate due to generation of offensive smell.

SUMMARY OF THE INVENTION

It is hence a primary object of the invention to present an air intake passage cleaning apparatus capable of cleaning the air intake passage and heat exchanger securely and improving the indoor environments, by comprising supplying means for supplying cleaning solvent, together with compressed air, to the heat exchanger side from the blow-out port through the air intake passage.

It is other object of the invention to present an air intake passage cleaning apparatus capable of improving the ease of cleaning operation, by disposing the above supplying means in an arbitrary blow-out port out of plural blow-out ports.

It is a different object of the invention to present an air intake passage cleaning apparatus capable of cleaning the entire region and heat exchanger securely even if the air intake passage is long in the passage length, by disposing the above supplying means in the blow-port port at the remotest position from the heat exchanger out of plural blow-out ports.

It is another object of the invention to present an air intake passage cleaning apparatus capable of cleaning the air intake passage and heat exchanger securely and improving the indoor environments, by cleaning the air intake passage by supplying compressed air and cleaning solvent from the blow-out port to the heat exchanger side through the air intake passage.

It is a further object of the invention to present an air intake passage cleaning apparatus capable of preventing the fluid after cleaning from flowing out from other blow-out port and enhancing the cleaning efficiency, by blocking other blow-out ports with a clocking member when supplying air and cleaning solvent from a specific blow-out port.

It is still other object of the invention to present an air intake passage cleaning apparatus capable of obtaining sanitary environments, by moving a cleaning and wiping element provided in the air intake passage by moving means, thereby cleaning and removing securely and cleanly the dirt depositing inside the air intake passage, for example, by the cleaning power of the cleaning solvent impregnated or adhered to the cleaning and wiping element.

It is a further different object of the invention to present an air intake passage cleaning apparatus capable of moving all cleaning and wiping elements together to the blow-out port side and cleaning and removing the dirt depositing inside the air intake passage in a short time, by blocking the other blow-out ports except for a specific blow-out port, when applying a transfer pressure supplied from the air supplying means to the cleaning and wiping elements provided in the air intake passage.

It is a still further different object of the invention to present an air intake passage cleaning apparatus capable of wiping and removing the dirt depositing inside the air intake passage by the cleaning and wiping elements, and freely changing the wiping position by the cleaning and wiping elements depending on the position and area of contamination, by towing and manipulating linear traction members linked to the cleaning and wiping elements.

Other objects of the invention will be clarified from the following description of the embodiment.

DESCRIPTION OF THE PREFERRED EMBODIMENTS

Figure 1:
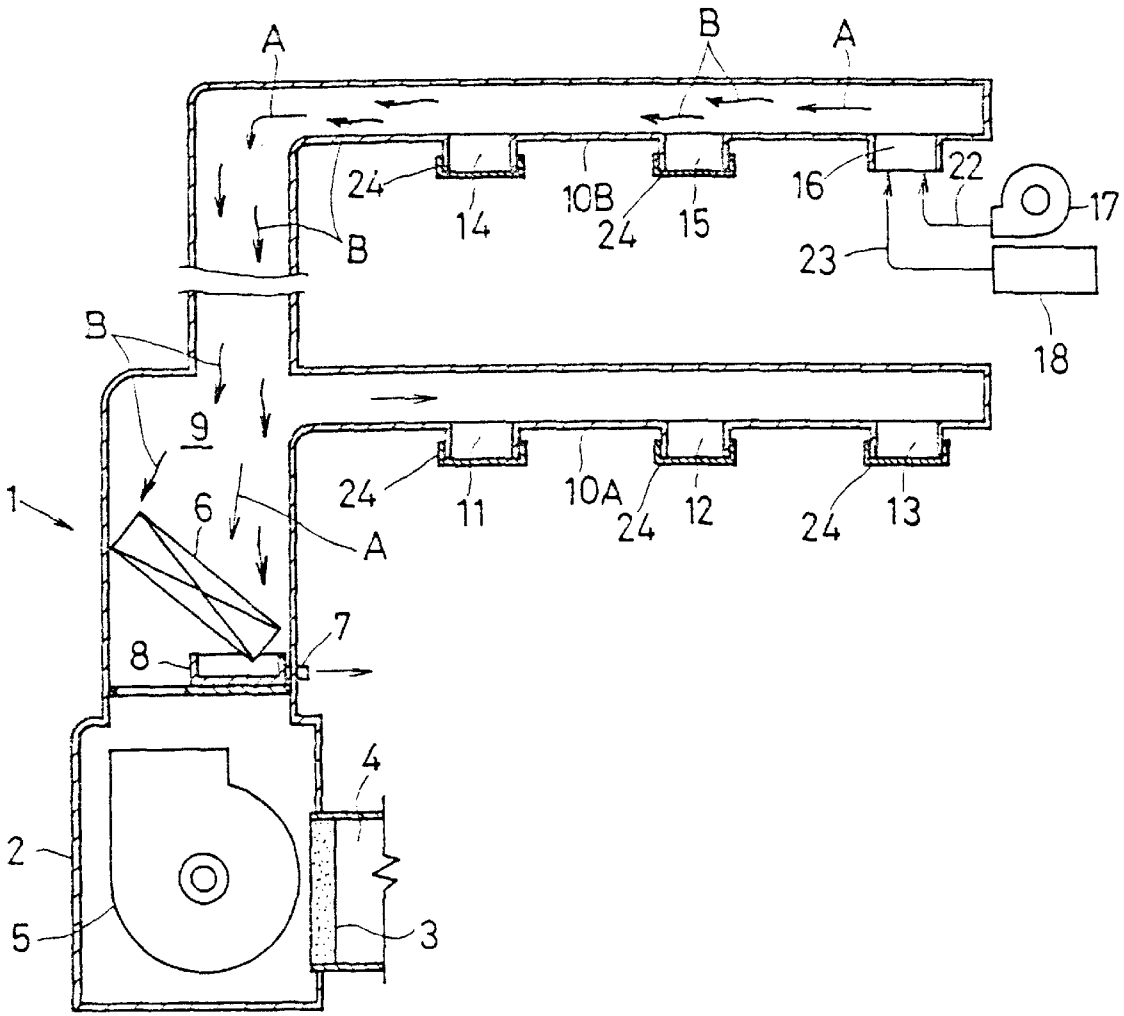
FIG. 1 is a sectional view showing an air intake passage cleaning method and its apparatus of the invention.

Referring now to the drawings, embodiments of the invention are described below.

The drawings show the air conditioning passage cleaning method and its apparatus of the air conditioner as an example of the air intake passage of the intake and exhaust apparatus, and referring first to FIG. 1, the constitution of the air conditioner is described.

The air conditioner 1 of the central air conditioning system shown in FIG. 1 comprises a housing 2 of an indoor unit, and an air suction port 4 having a filter 3 communicates to the air suction side of the housing 2, and a fan 5 is provided in the housing 2.

In the downstream of the fan 5, a heat exchanger 6 working as an evaporator when cooling and working as a condenser when heating is disposed, and a drain pan 8 having a drain pipe 7 is disposed in the lower part of the heat exchanger 6. The heat exchanger 6 communicates and connects to an outdoor unit (not shown).

To communicate to a downstream side chamber 9 of the heat exchanger 6, ducts 10A, 10B of each air conditioning area (the air conditioning area of each floor in the case of a building, the air conditioning area of each vehicle or cabin in the case of a moving structure) are provided, and plural blow-out ports 11, 12, 13, 14, 15, 16 are opened in these ducts 10A, 10B.

Figure 2:
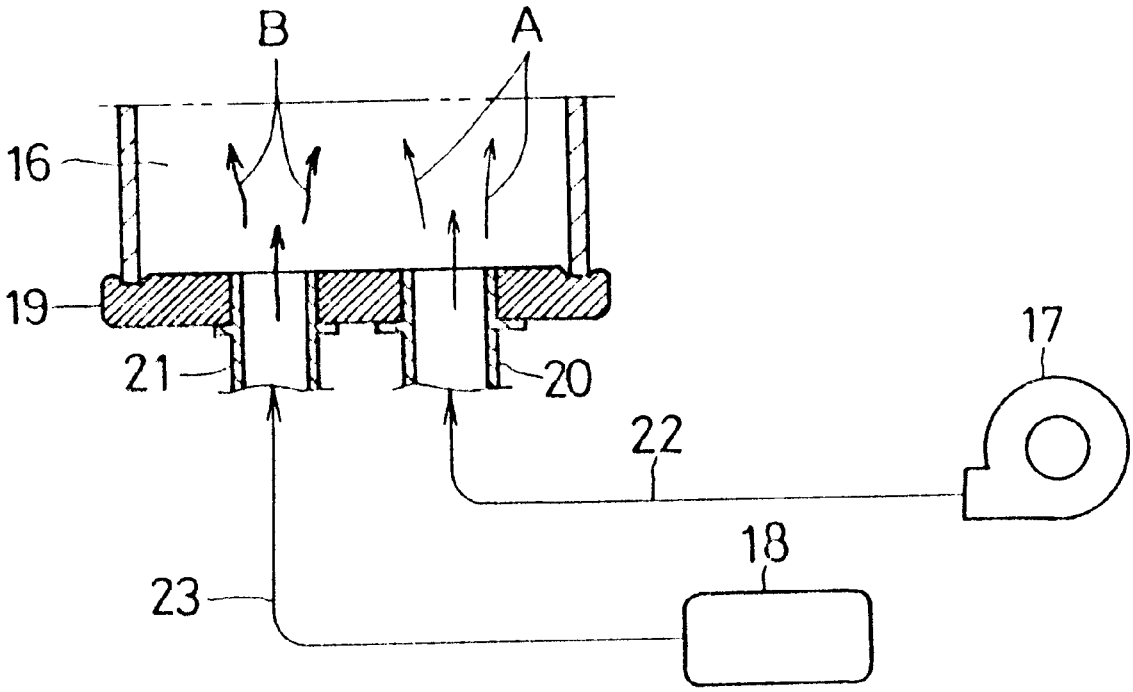
FIG. 2 is an essential magnified view of FIG. 1.

An air intake passage cleaning apparatus in a first embodiment for cleaning thus constituted air conditioner 1 comprises, as shown in FIG. 1 and FIG. 2, a blowing fan as blowing means for sending compressed air A, and a solvent source 18 for supplying a cleaning solvent B by making use of the air flow by the blowing fan 17.

In this embodiment, an arbitrary blow-out port of the plural blow-out ports 11 to 16 (preferably the blow-out port positioned at a considerably remote position from the heat exchanger 6) or the blow-out port 16 at the remotest position from the heat exchanger 6 is provided with a detachable seal member 19, and two joint pipes 20, 21 are disposed in this seal member 19.

One joint pipe 20 communicates and connects to the discharge port of the blowing fan 17 through a blowing line 22, and other joint pipe 21 communicates and connects to the solvent source 23 through a solvent line 23.

Herein, the cleaning solvent B may be liquid detergent, foamy (mousse) detergent (water, phosphoric acid, Softanol 70, propylene glycol monomethyl ether MFG, and others properly blended), cleaning water, or soap water, which may be used alone, or such cleaning solvent B may be mixed with solvents having other functions such as aromatic, medicine, deodorant, bactericide, fungicide and others to be used as compound.

The solvent source 18 may be of filled container type for discharging the solvent by the pressure of sealing gas, or a pump or the like may be also used for pumping out the solvent by force if the solvent discharge force is insufficient by the blowing force of the blowing fan 17 alone.

Moreover, when supplying the air A and cleaning solvent B from a specific blow-out port (for example, blow-out port 16). a detachable blocking member 14 is provided to block the other blow-out ports 11 to 15 air-tightly. The blocking member 24 may be lid, plug, sheet, tape, packing, or other members, and these blocking members 24 close the blow-out ports 11 to 15 according to the structure of the blow-out ports 11 to 15.

Using thus constituted air intake passage cleaning apparatus. to clean the ducts 10A, 10B and heat exchanger 6 of the air conditioner 1, first the fan 5 is stopped, and then the other blow-out ports 11 to 15 are closed by the blocking members 24.

Then, as shown in FIG. 1 and FIG. 2, the seal member 19 is attached to the specific blow-out port (for example, blow-out port 16), and the cleaning solvent B is supplied, together with the compressed air A, from the two joint pipes 20, 21 to the duct 10B and the heat exchanger 6 through the downstream side chamber 9 as indicated by arrow in FIG. 1.

That is, the cleaning solvent B is supplied in the opposite direction to the flowing direction of the normal air conditioning flow. In this case, since the ducts 10B, 10A communicate to each other, the cleaning solvent B is also supplied to the duct 10A side.

In this way, when the cleaning solvent B is supplied from the specific blow-out port (for example, the blow-out port 16 at the position remotest from the heat exchanger 6) to the heat exchanger 6 side, the inside of the ducts 10B, 10A and heat exchanger 6 can be cleaned by this cleaning solvent B. and the waste liquid after cleaning is discharged outside of the housing 2 from the drain pipe 8 through the drain pipe 7.

In particular, when foamy cleaning solvent B is used, this foamy cleaning fluid spreads in the whole area of the ducts 10B, 10A by its nature, and is supplied to the heat exchanger 6 side by the compressed air A, and a high cleaning efficiency is maintained, but the cleaning solvent B is not limited to the foamy type alone.

Figure 3:
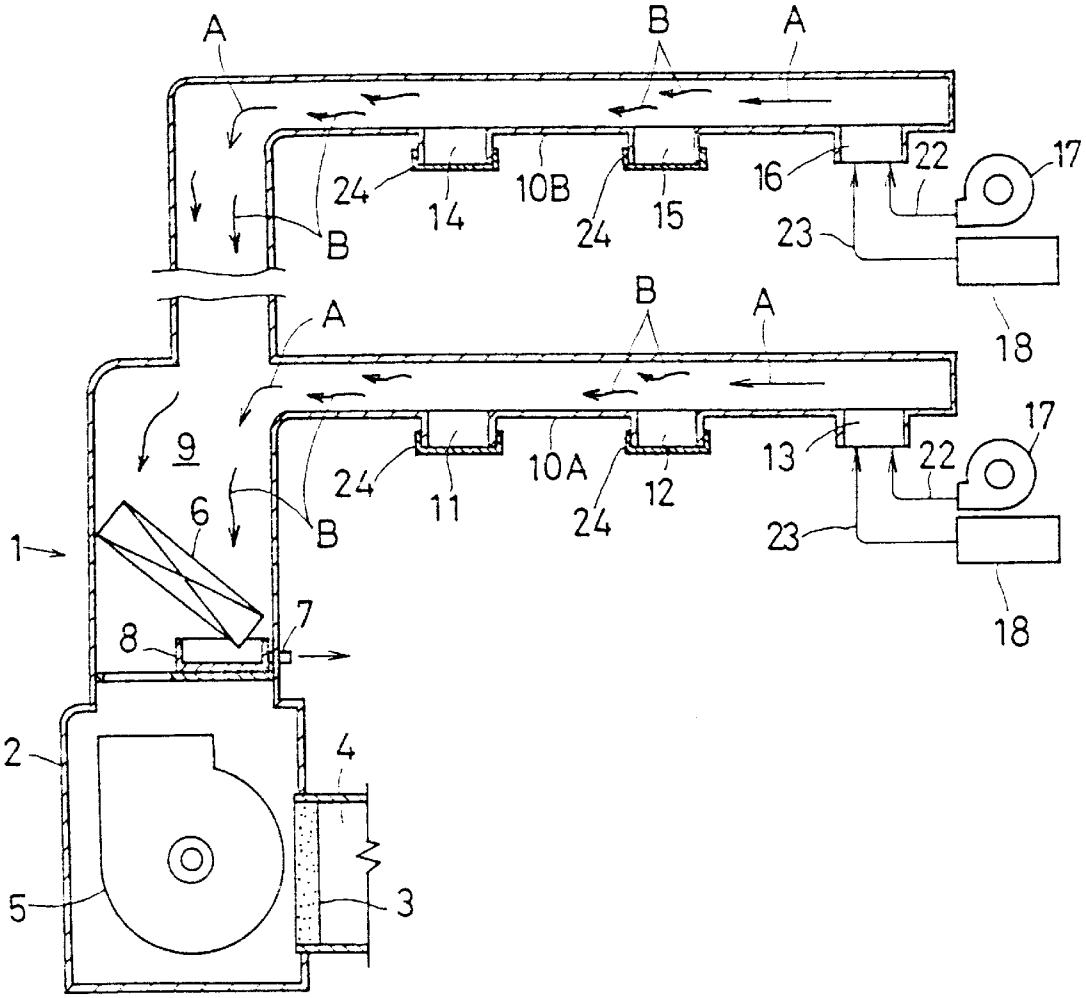
FIG. 3 is a sectional view showing other embodiment of air intake passage cleaning method of the invention.

Incidentally, as shown in FIG. 1, in the duct 10B corresponding to one air conditioning area, after supplying the cleaning solvent B together with compressed air A from the blow-out port 16 at the position remotest from the heat exchanger 6, similarly, the cleaning solvent B may be supplied, together with the compressed air A, from the blow-out port 13 in the duct 10A corresponding to other air conditioning area, or As in an apparatus of a second embodiment shown in FIG. 3, the cleaning solvent B may be supplied together with the compressed air A into both blow-out ports 13, 16 positioned remotely from the heat exchanger 6 in the ducts 10A, 10B in the air conditioning areas, so that both enhancement of cleaning efficiency of the ducts 10A, 10B and shortening of cleaning time may be achieved.

After cleaning, of course, the inside of the ducts 10A, 10B may be dried by supplying only compressed air A from the blowing fan 17.

Thus, according to the air intake passage cleaning apparatus of the embodiments, by supplying the cleaning solvent B together with the compressed air A to the heat exchanger 6 side from the blowing fan 17 and solvent source 18 through the ducts 10A, 10B, the ducts 10A, 10B and the heat exchanger 6 can be cleaned securely by the cleaning solvent B supplied by the air A.

Accordingly, by starting air conditioning operation after cleaning, offensive smell or the like is not generated and the indoor environments may be enhanced.

Moreover, since the cleaning solvent B can be supplied together with the compressed air A through an arbitrary blow-out port out of the blow-out ports 11 to 16 from the blowing fan 17 and solvent source 18, the ease of cleaning operation can be enhanced. In particular, it is effective when it is hard to supply from the blow-out ports 13, 16 due to obstacles or the like positioned beneath the blow-out ports 13, 16.

Further, since the cleaning solvent B can be supplied together with the compressed air A through the blow-out port 16 at the remotest position from the heat exchanger 6, out of the blow-out ports 11 to 16, from the blowing fan 17 and solvent source 18, if the air intake passage of the ducts 10B, 10A is long, the entire length and the heat exchanger 6 can be cleaned securely.

On the other hand, according to an air intake passage cleaning apparatus of an embodiment, when the cleaning solvent B is supplied together with the compressed air A to the heat exchanger 6 side from the blow-out port through the air intake passages (see ducts 10A, 10B), the air intake passages and heat exchanger 6 can be securely cleaned by the cleaning solvent B supplied by the air A.

Besides, when supplying the air A and the cleaning solvent B from a specific blow-out port (for example, blow-out port 16), since the blow-out ports 11 to 15 are closed by the blocking members 24, the fluid after cleaning is prevented from flowing out from the blow-out ports 11 to 15, and also the air A is prevented from escaping from the blow-out ports 11 to 15, so that the air A and cleaning solvent B can be efficiently guided to the heat exchanger 6 side, thereby enhancing the cleaning efficiency.

Figure 4:
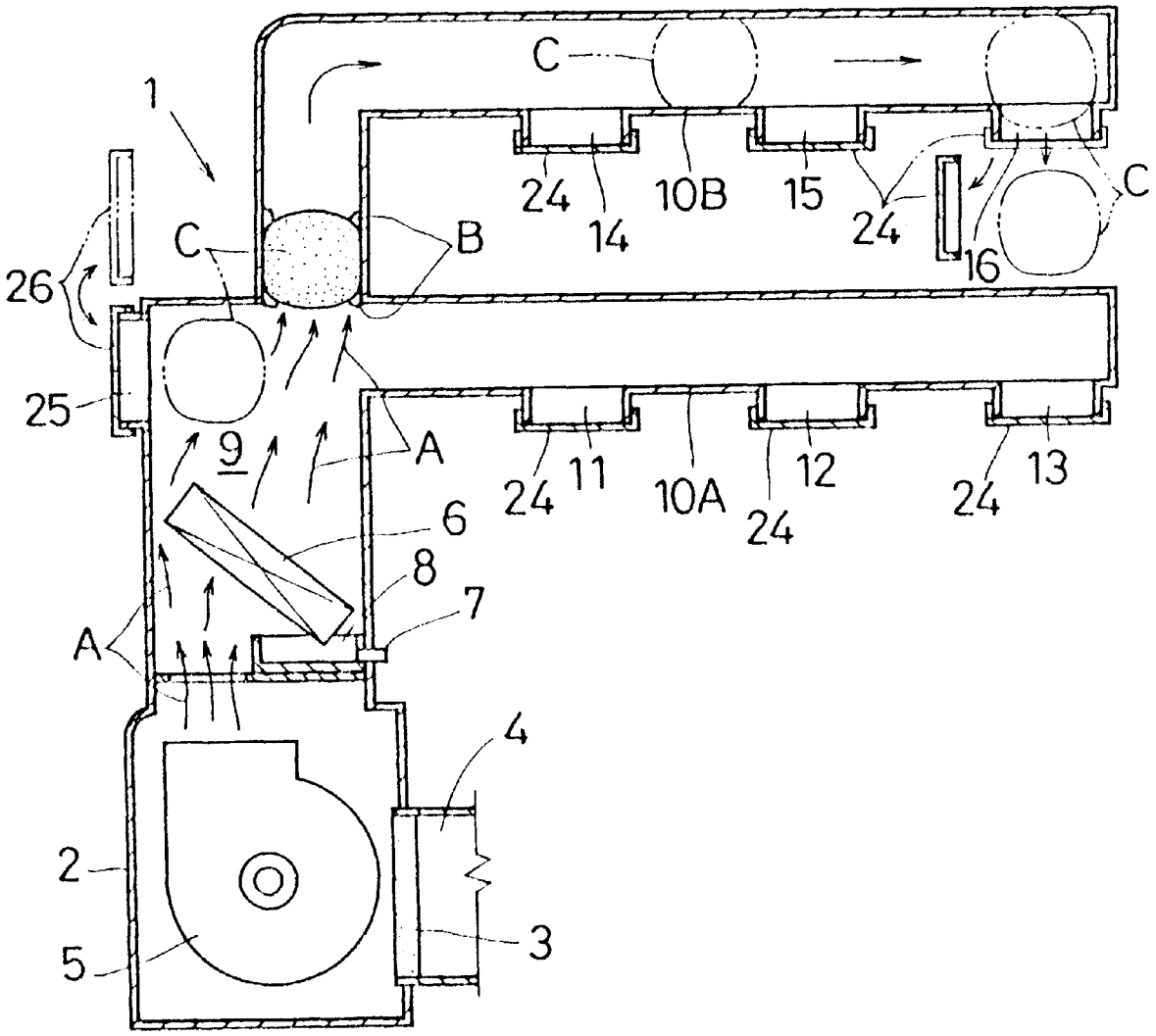
FIG. 4 is a sectional view showing a different embodiment of air intake passage cleaning method and its apparatus of the invention.

The air intake passage cleaning method and apparatus in a third embodiment shown in FIG. 4 comprise cleaning and wiping elements C impregnated with cleaning solvent B and loaded inside of ducts 10A, 10B, and a fan 5 for supplying air A in the direction of moving the cleaning and wiping elements C toward a specific blow-out port (for example, blow-out port 16).

The cleaning and wiping elements C are composed of flexible and elastic members such as sponge, and are formed in a size and shape to abut against the inner wall of the ducts 10A, 10B, tightly contacting with almost entire peripheral surface. The cleaning and wiping elements C may be also replaced by, for example, brushes planting multiple bristles, non-woven cloth made from fibers, or cotton-like mesh made of entangled wire materials.

When cleaning, after stopping the fan 5, the blow-out ports 11 to 15, except blow-out port 16, are closed by blocking members 24, and a blocking member 26 at an entrance 25 formed in the side chamber 9 is opened, and the cleaning and wiping elements C impregnated with solvent are loaded inside the duct 10B.

After closing the entrance 25 with the blocking member 26, the fan 5 is driven, and the transfer pressure of the air A is applied positively to the cleaning and wiping elements C, and the cleaning and wiping elements C are moved at once toward the blow-out port 16 side, and the dirt deposits inside the duct 10 are quickly cleaned and removed in a short time by the synergistic actions of the cleaning solvent B and the cleaning and wiping elements C, and by repeating the operation for some times, the remaining dirt can be completely cleaned and removed.

The cleaning solvent B and cleaning and wiping elements C discharged from the blow-out port 16 are recovered, and the cleaning and wiping elements C are washed in water or detergent, and recycled. It is also possible to clean while supplying the cleaning solvent B into the duct 10B, or to clean the inside of the duct 10B by dismounting the heat exchanger 6.

When cleaning the duct 10A, the blow-out port 13 is opened, and the blow-out ports 11, 12, 14, 15, 16 are closed and the inside of the duct 10A is cleaned. By opening the blow-out ports 13, 16 of the ducts 10A,10B, closing the blow-out ports 11, 12, 14, 15, and cleaning the ducts 10A, 10B simultaneously, the working time can be shortened and the working efficiency can be enhanced.

By laying or applying a protective member (not shown) such as cover and sheet beneath or around a specific blow-out port, the cleaning work can be done cleanly and hygienically.

In this way, since the cleaning and wiping elements C loaded in the ducts 10A, 10B are moved by transfer pressure of air A, the dirt deposits of the ducts 10A, 10B can be securely and cleanly removed by the synergistic actions of the cleaning solvent B and cleaning and wiping element C, and sanitary environments can be obtained.

Moreover, since the cleaning and wiping elements C are moved simultaneously toward a specific blow-out port (for example, blow-out port 16), and the time required for removing the dirt deposits inside the ducts 10A, 10B is shortened, and the working time can be shortened notably. At the same time, the job can be done simply and easily, and the working efficiency can be enhanced.

Figure 5:
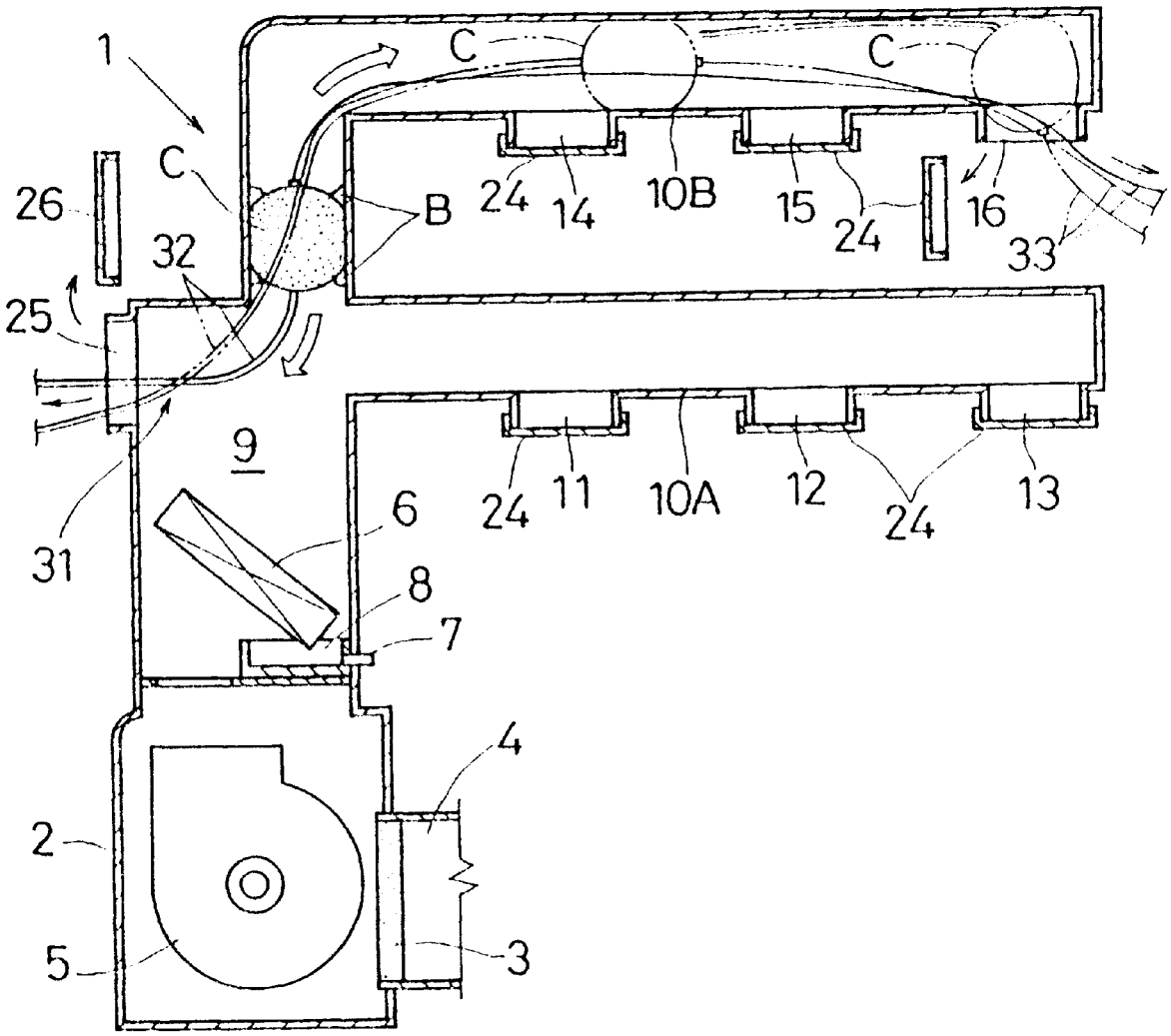
FIG. 5 is a sectional view showing a further different embodiment of air intake passage cleaning method and its apparatus of the invention.

The air intake passage cleaning method and its apparatus of a fourth embodiment shown in FIG. 5 are designed to clean and remove dirt deposits in the ducts 10A, 10B by towing and operating linear traction members 31 linked to the cleaning and wiping elements C.

The traction member 31 is composed by coupling and fixing flexible traction wire 32 And traction cord 33, the cleaning and wiping element C is fixed to the end of the traction wire 32, and the traction wire 32 and traction cord 33 are formed longer than the distance linking the blow-out port 16 and entrance 25. Instead of the traction wire 32, for example, rope, chain or the like may be also used.

When cleaning, the fan 5 is stopped, the blow-out ports 11 to 15, except blow-out port 16, are closed, the traction cord 33 is inserted into the inside of the duct 10B from the entrance 25 side of the side chamber 9, and the traction wire 32 drawn out to the entrance 25 side and the traction cord 33 drawn out to the blow-out port 15 side are alternately towed and operated by hand, so that the dirt deposits inside the duct 10B can be cleaned and removed by the synergistic actions of the cleaning solvent B and cleaning and wiping elements C.

Besides, depending on the position and area of dirt, the wiping position by the cleaning and wiping elements C can be freely changed. It is also possible to clean while supplying cleaning solvent B into the duct 10B.

Alternatively, the traction cord 33 may be also connected through, for example, a connector to the cleaning and wiping element C or traction wire 32 projecting to the blow-out port 16 side. Or, the traction wire 32 and traction cord 33 may be mechanically towed by traction means such as winch.

After drawing out the traction cord 33 to the blow-out port 13 side of the duct 10, or drawing out to the blow-out port 11, 12 side of the duct 10A or the blow-out port 14, 15 side of the duct 10B, by towing and manipulating the traction wire 32 and traction cord 33, the dirt deposits in the ducts 10A, 10B can be cleaned and removed by the cleaning and wiping elements C.

Meanwhile, without linking the traction cord 33, only the traction wire 32 may be inserted into the duct 10B, and the dirt deposits inside the duct 10B may be cleaned and removed by the cleaning and wiping elements C fixed to the traction wire 32.

Figure 6:
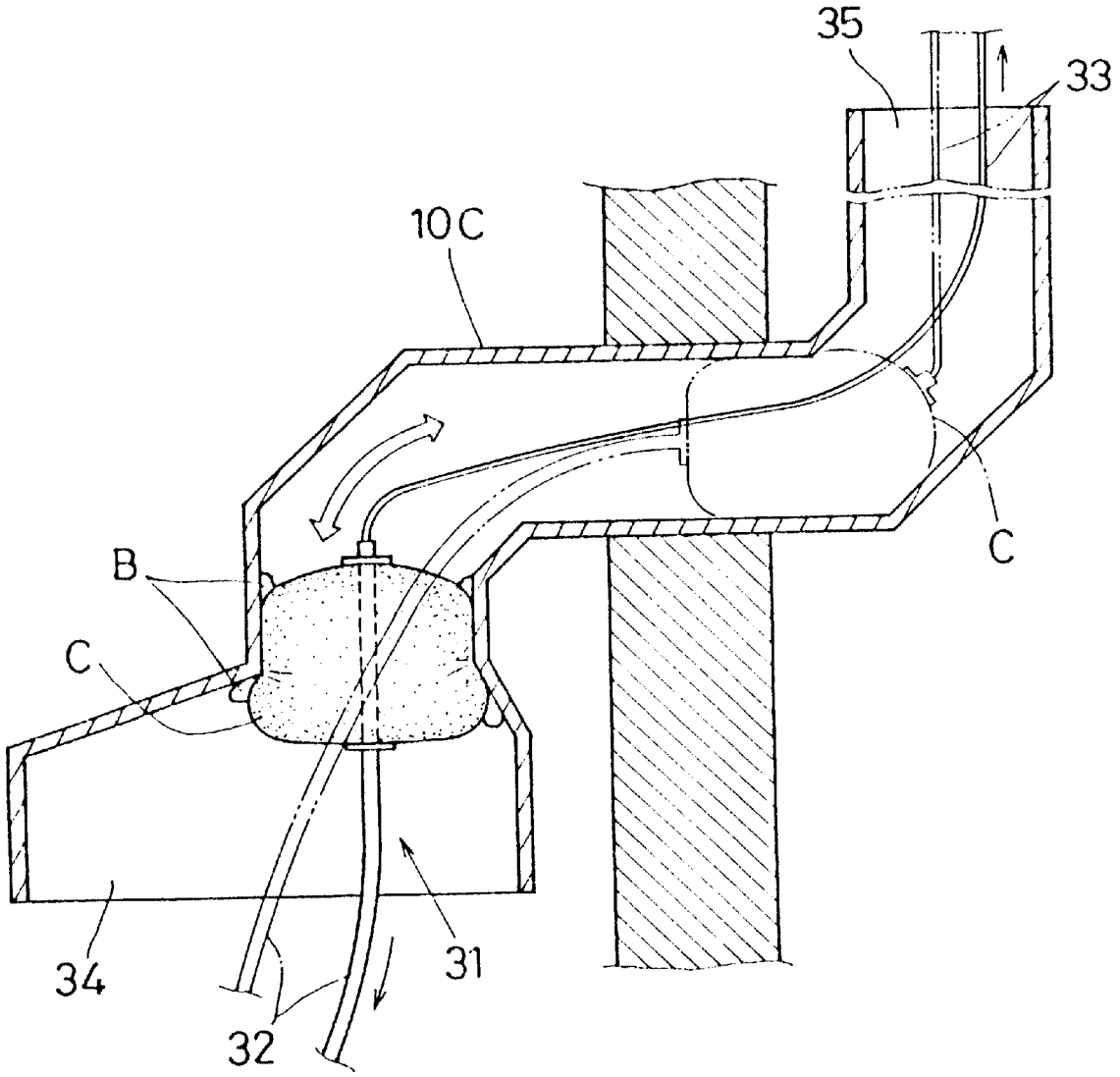
FIG. 6 is a sectional view showing a duct cleaning method.

Incidentally, as shown in FIG. 6, for example, by inserting a traction member 31 into a duct 10C piped in the kitchen or the like, and towing and manipulating the traction wire 32 drawn out to the air intake 32 side and the traction cord 33 drawn out to the exhaust port 35 side, the dirt deposits inside the duct 10C can be cleaned and removed by the cleaning and wiping elements C.

Also, by loading the cleaning and wiping elements C only in side the duct 100, and moving the cleaning and wiping elements C by making use of the transfer pressure by the air A or the negative pressure by the vacuum pump, the dirt deposits inside the duct 10C can be cleaned and removed.

Figure 7:
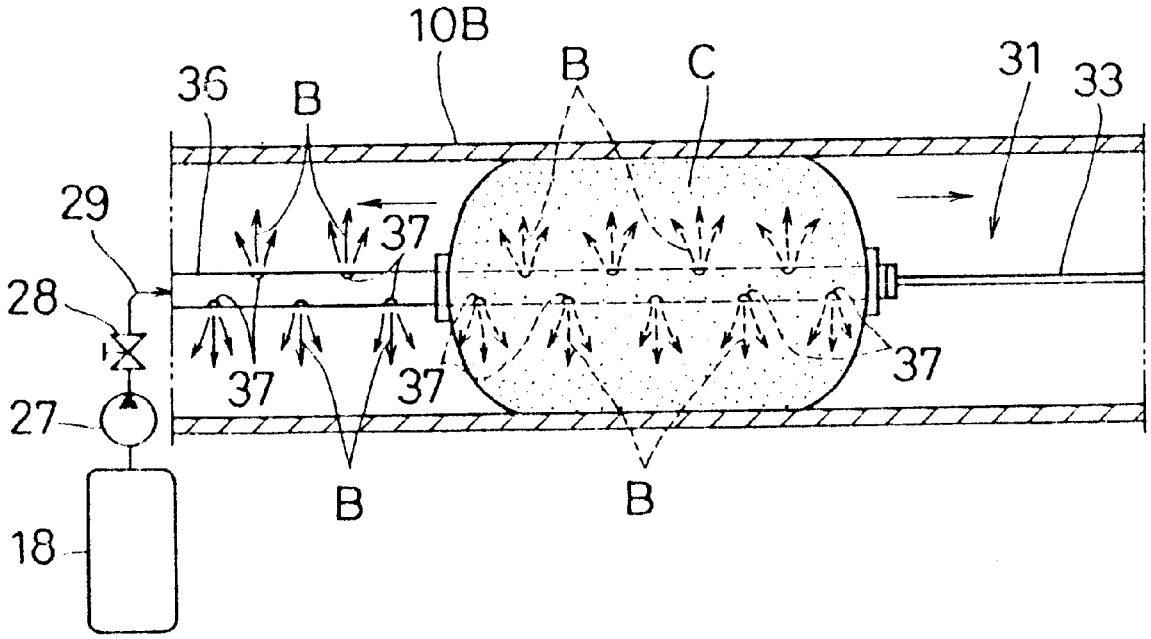
FIG. 7 is a sectional view showing a still different embodiment of air intake passage cleaning method and its apparatus of the invention.
Figure 8:
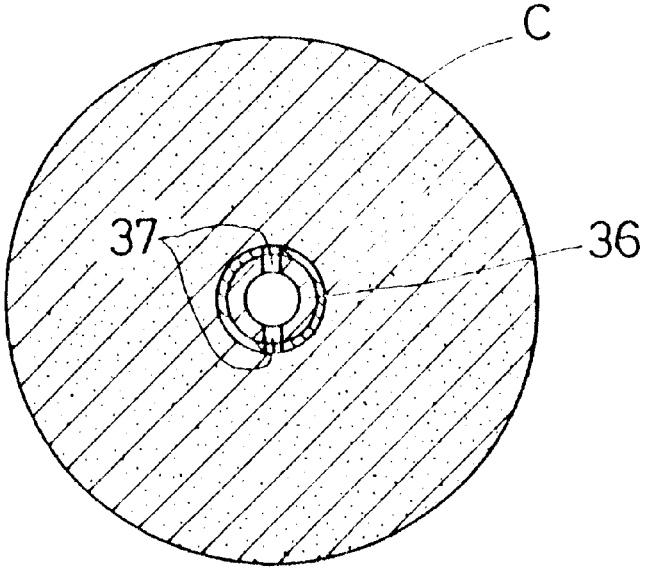
FIG. 8 is a sectional view showing a mounting state of cleaning and wiping elements and traction pipes.

The air intake passage cleaning method and its apparatus of a fifth embodiment shown in FIG. 7 and FIG. 8 are designed to clean and remove the dirt while blowing the cleaning solvent B to the inner wall of the ducts 10A. 10B.

The cleaning and wiping elements C are fixed to the end of traction pipes 35 formed elastically, holes 37 . . . for discharging the cleaning solvent B around the traction pipes 35 are formed at specific intervals in the length direction, the traction cord 33 and traction pipe 36 are coupled, and the solvent source 18 and traction pipe 36 are connected by a feed line 29 through a pump 27 and a valve 28.

When cleaning, after inserting the traction pipe 36 and cleaning and wiping elements C into the duct 10B, the cleaning solvent B stored in the solvent source 18 is supplied into the traction pipe 36 by the pump 27, and the cleaning solvent B discharged from the holes 37 . . . of the traction pipe 36 is sprayed to the inner wall of the duct 10B, and the dirt deposits in the duct 10B are cleaned and removed by the cleaning and wiping elements C, so that the solvent is stably obtained in an amount suited to cleaning, and therefore the cleaning job can be done efficiently.

Or, traction pipe 36 may be inserted into the duct 10B, and the inside of the duct 10B may be cleaned by the wiping and cleaning elements C fixed in the traction pipe 36.

Figure 9:
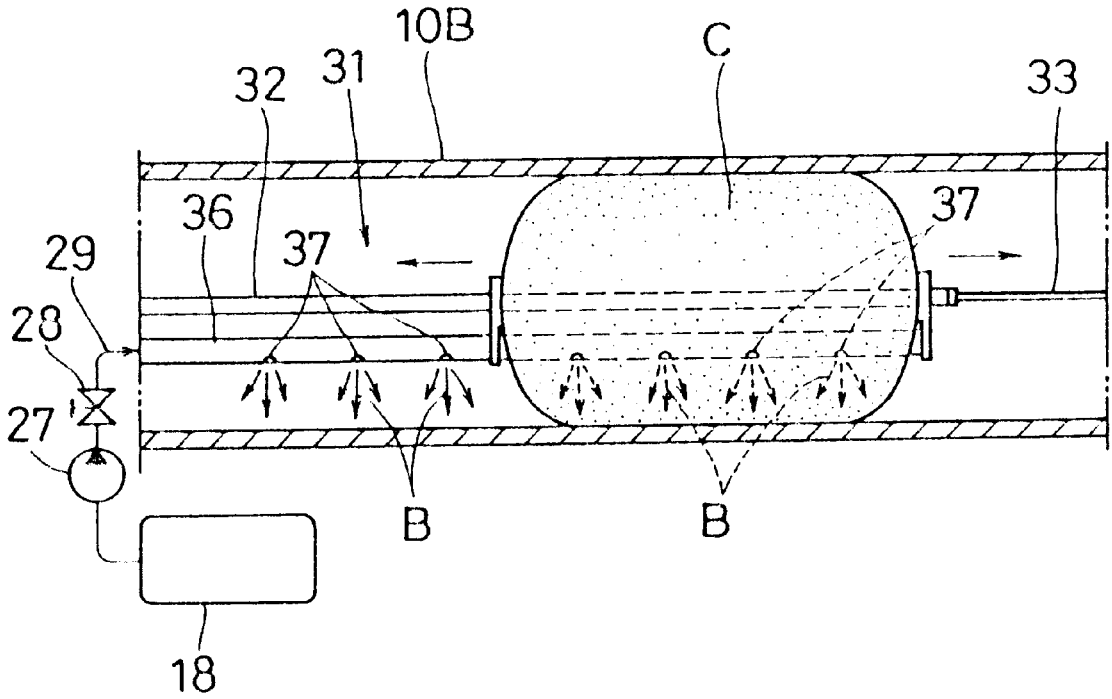
FIG. 9 is a sectional view showing a cleaning method by traction wires and traction pipes.
Figure 10:
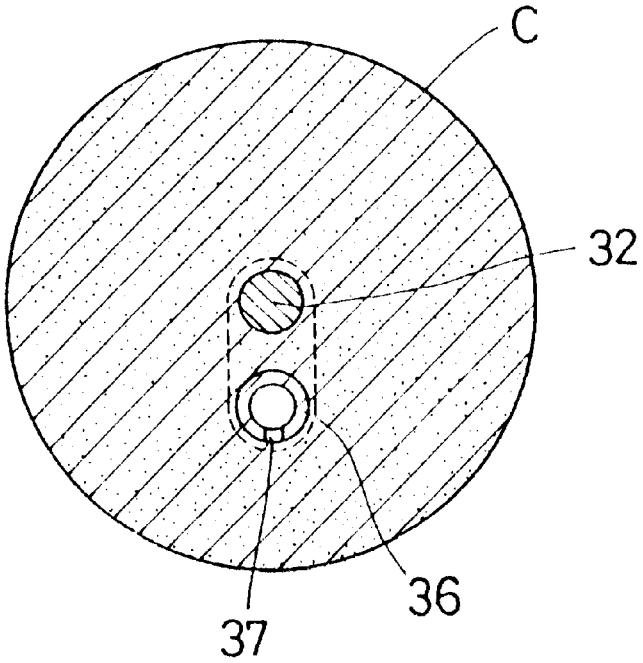
FIG. 10 is a sectional view showing a mounting state of traction wires and traction pipes.

Also, as shown in FIG. 9 and FIG. 10. the traction pipe 36 may be also fitted along the side periphery of the traction wire 32, and by spraying the cleaning solvent B discharged from the holes 37 . . . of the traction pipe 36 to the inner wall of the duct 10B, and the dirt deposits in the duct 10B are cleaned and removed by the cleaning and wiping elements C.

Figure 11:
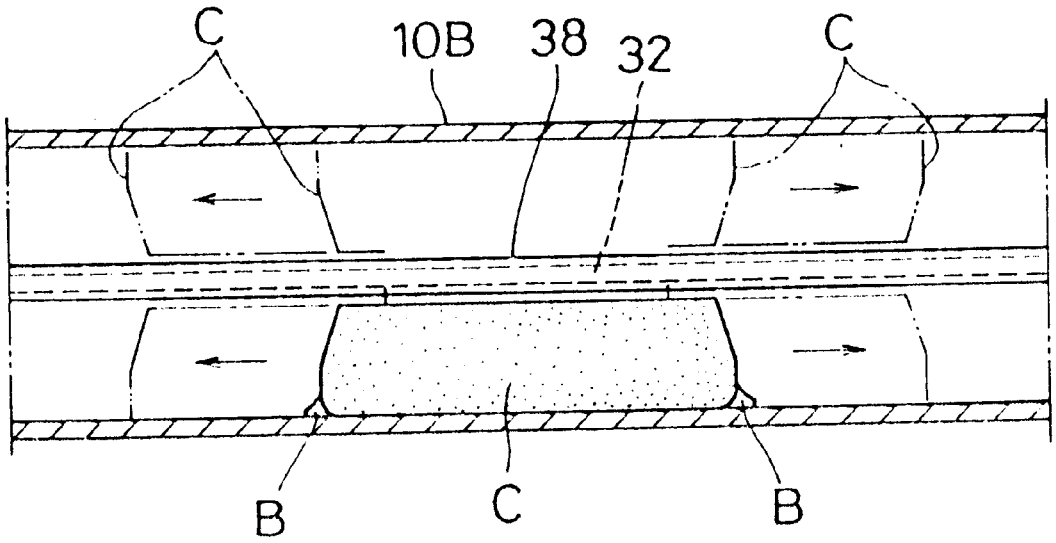
FIG. 11 is a sectional view showing another different embodiment of air intake passage cleaning method and its apparatus of the invention.
Figure 12:
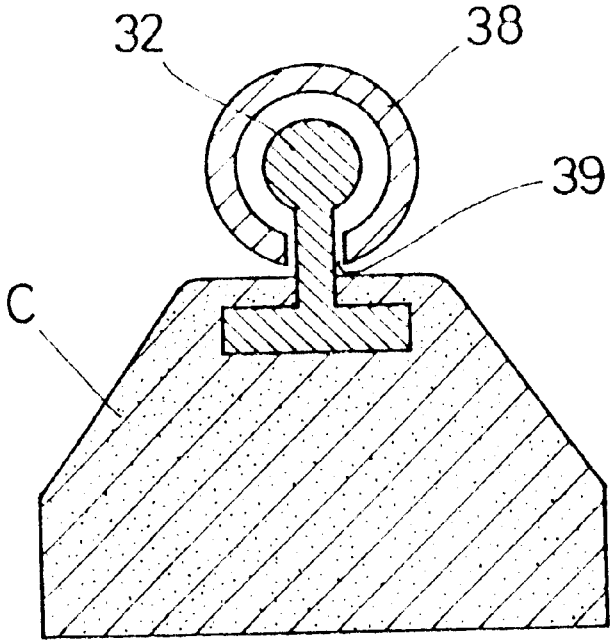
FIG. 12 is a sectional view showing a mounting state of cleaning and wiping elements.

The air intake passage cleaning method and its apparatus of a sixth embodiment shown in FIG. 11 and FIG. 12 are designed to clean and remove the dirt deposits from the inside of the ducts 10A, 10B, by sector or trapezoidal cleaning and wiping elements C coupled to the traction wire by towing and operating the traction wire 32 along a wire guide 38.

The traction wire 32 is inserted into the wire guide 38 formed elastically, and the traction wire 32 and cleaning and wiping elements C are integrally coupled through a guide groove 39 formed at the side of the wire guide 38.

After inserting the wire guide 38 into the duct 10B, by towing and manipulating the traction wire 32, the cleaning and wiping elements C impregnated with the solvent are moved along the wire guide 38, so that the dirt deposits in the duct 10 can be wiped, cleaned and removed accurately, thereby securely preventing dislocation of the wiping position.

At the same time, contact between the duct 10B and traction wire 32 can be prevented, and the duct 10B is prevented securely from being broken or damaged. It is also possible to clean while supplying the cleaning solvent B into the duct 10B.

Figure 13:
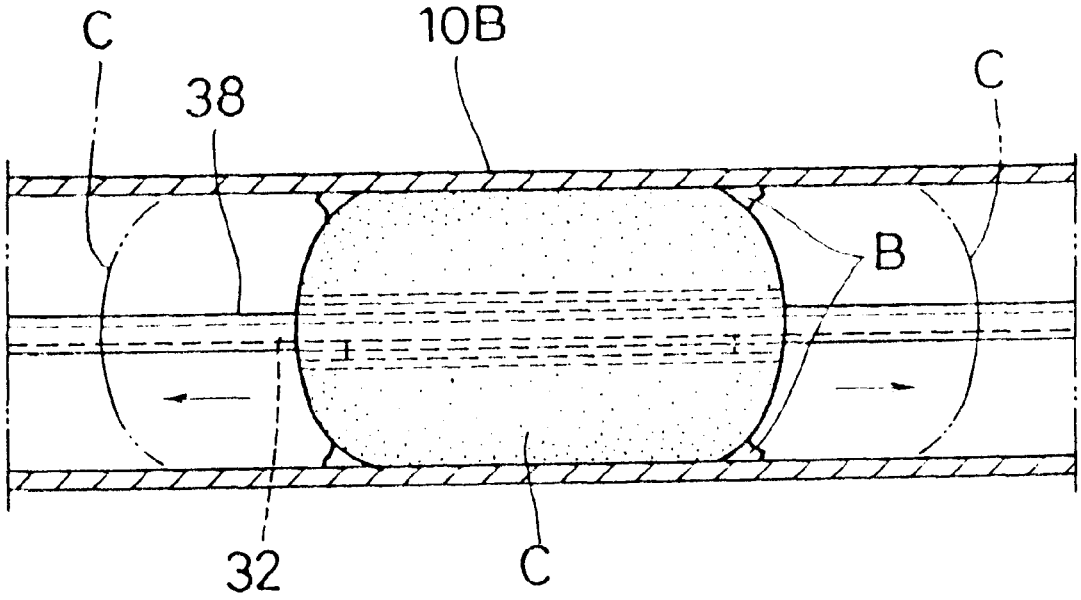
FIG. 13 is a sectional view showing a cleaning method by tubular cleaning and wiping elements.
Figure 14:
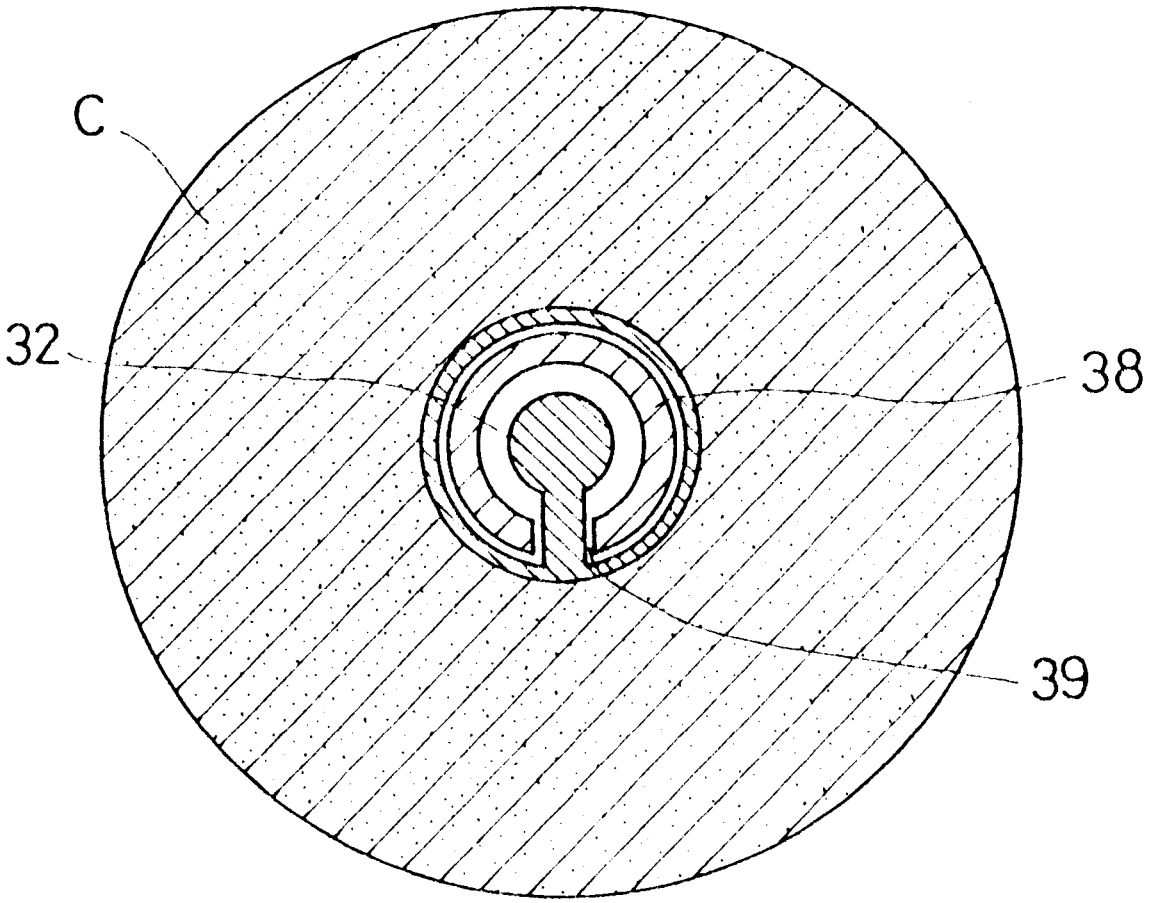
FIG. 14 is a sectional view showing a mounting state of tubular cleaning and wiping elements.

As shown in FIG. 13 and FIG. 14, by coupling the traction wire 32 inserted into the wire guide 38 and the tubular cleaning and wiping element C freely fitted to the outer circumference of the wire guide 38, towing and manipulating the traction wire 32, and moving the cleaning and wiping elements C impregnated with solvent along the wire guide 38, the dirt deposits in the duct 10B can be cleaned and removed simultaneously, and the working efficiency can be improved.

In the correspondence between the constitution of the invention and the above embodiments, the air intake passages of the invention correspond to the ducts 10A, 10B, 10C of the embodiments, and similarly, the supplying means, to the blowing fan 17 and solvent source 18, the moving means, to the fan 5 and traction member 31, the air supplying means, to the fan 5, and the traction member, to the traction member 31, traction wire 32, traction cord 33, and traction pipe 36, but the invention is not limited to the illustrated embodiments alone.

For example, in FIG. 1. FIG. 3, FIG. 4, and FIG. 5, the object of cleaning is the air conditioner of the central air conditioning system, but it may be also applied to the air conditioners of other types.

Alternatively, mesh members may be disposed inside of the seal member 19, and the soap water supplied from the solvent line 23 may be foamy, or depending on the structure, since the ducts 10B, 10A may be disposed at a higher position than the heat exchanger 6, so that the lift may be effectively utilized.

What is claimed is:

1. A cleaning apparatus for use in cleaning the inside walls of a passage through which air travels to or from a heat exchanger and having a plurality of ports and an entrance, said apparatus comprising:

means for closing in a leak proof manner all of said plurality of ports except at least one port;

at least one wiping means impregnated with a cleaning solvent inserted into said passage through said entrance and removed through said at least one port, said at least one wiping means abutting at least parts of said inside walls of said passage; and means for supplying air flow under positive pressure into said passage through said entrance thereby to propel said at least one wiping means impregnated with cleaning solvent through said passage thereby to loosen deposit on said inside walls of said passage.

2. The apparatus of claim 1, wherein said at least one port is located furthest from said heat exchanger and said at least one wiping means is removed through said at least one port.

3. The apparatus of claim 1, wherein said means for supplying air flow comprises a fan.

4. A method of cleaning the inside walls of a passage through which air travels to or from a heat exchanger and having a plurality of ports and an entrance, said method comprising the steps of:

closing in a leak proof manner all of said plurality of ports except at least one port;

inserting at least one wiping means impregnated with a cleaning solvent into said passage through said entrance with said at least one wiping means abutting at least parts of said inside walls of said passage;

supplying air flow under pressure into said passage through said entrance thereby to propel said at least one wiping means impregnated with cleaning solvent through said passage thereby to loosen deposit on said inside walls of said passage; and removing said at least one wiping means and said loosened deposits from said at least one port.

5. The method of claim 4, wherein said at least one port is located furthest from said heat exchanger, and said entrance is located close to said heat exchanger.

6. The method of claim 4, wherein said air flow is supplied by a fan.

* * * * *